United States Patent [19]

Rubin

[11] 4,025,966

[45] May 31, 1977

[54] PORTABLE AND COLLAPSIBLE SITZ BATH RECEPTACLE

[76] Inventor: Raymond Rubin, 345 Ocean Drive, Miami Beach, Fla. 33139

[22] Filed: June 24, 1976

[21] Appl. No.: 699,236

[52] U.S. Cl. ..... 4/6

[51] Int. Cl.[2] ..... A47K 3/22; A47K 11/08

[58] Field of Search ..... 4/6, 7, 177, 177 CW; 206/287; 229/65

[56] References Cited

UNITED STATES PATENTS

| | | | |
|---|---|---|---|
| 1,679,828 | 8/1928 | Johnson | 206/287 |
| 2,001,264 | 5/1935 | Moore | 206/287 |
| 2,443,440 | 6/1948 | Alvarez | 4/177 CW |
| 2,487,228 | 11/1949 | Feichtmein | 4/177 X |
| 2,645,786 | 7/1953 | Loftin | 4/177 X |
| 3,066,312 | 12/1962 | Reavis | 4/7 |
| 3,159,096 | 12/1964 | Tocker | 229/65 |
| 3,916,452 | 11/1975 | Alt | 4/6 |

*Primary Examiner*—Henry K. Artis
*Attorney, Agent, or Firm*—Erwin M. Barnett

[57] ABSTRACT

An envelope of water impervious sheet material is sized to rest on and overlap the open top edge of a toilet bowl beneath the seat. A relatively rigid ring is positioned within the envelope and is sized to extend across the toilet bowl top edge from rear to front and to be narrower widthwise than the envelope to provide leaway and support for sagging of the envelope in its central portion forming a receptacle for liquid of the sitz bath.

4 Claims, 4 Drawing Figures

PORTABLE AND COLLAPSIBLE SITZ BATH RECEPTACLE

BACKGROUND OF THE INVENTION

1. Field of the invention

This invention relates to a portable and collapsible liquid receptacle or bowl for converting a conventional toilet bowl to a sitz bath.

2. Description of the prior art

Portable sitz baths intended for use on the conventional toilet bowl are usually made of preformed rigid material which forms a clumsy, relatively large device requiring a bulky container for storing and occupying excessive space in a suitcase when traveling. Such devices are also relatively expensive, requiring costly tooling for production molds. As an alternative, it has been suggested that a pliable plastic envelope, disposable or reusable, be fashioned to slip over the toilet seat with a sagging middle to provide the liquid receptacle. Such device has failed to meet with public acceptance for what appears to be an obvious reason, namely, that the required act of fitting the envelope onto the toilet seat is repulsive and fails to capture the imagination of prospective users.

SUMMARY OF THE INVENTION

Among the objects of the invention is to provide a readily portable and collapsible liquid receptacle which shall be of durable, rugged construction and easy to clean for repeated and convenient use on all conventional toilet bowls currently found in the home, and which shall comprise few and simple parts for manufacture and assembly into a relatively low cost structure.

The invention contemplates an envelope of liquid impervious and pliable sheet material, sized and shaped to rest upon and overlap the rim of a coventional toilet bowl and to be depressed in the center portion thereof providing a receptacle or bowl within the toilet bowl for filling with liquid as a sitz bath for a person seated on the toilet seat which is lowered to rest on the envelope. A feature of the invention is the relatively rigid oblong shaped ring which is contained within the envelope and is sized and shaped to have the long axis thereof extend from rear to front, resting on rear and front portions of the toilet bowl rim and being adapted to serve as a support for the liquid filled depressed envelope receptacle. The ring is free within the confines of the envelope for relative movement between envelope and ring whereby the depression of the center portion of the envelope, which is also within the ring, adapts to a wide range of toilet bowl sizes and shapes. The ring may be made of a noncorrosive metal wire which is bent into the oblong configuration with opposite ends brought into abutment and retained together by a sleeve which is then located in the front of the envelope to serve as hand-gripping means for manipulating the device.

DESCRIPTION OF THE PREFERRED EMBODIMENT

Figure 1:
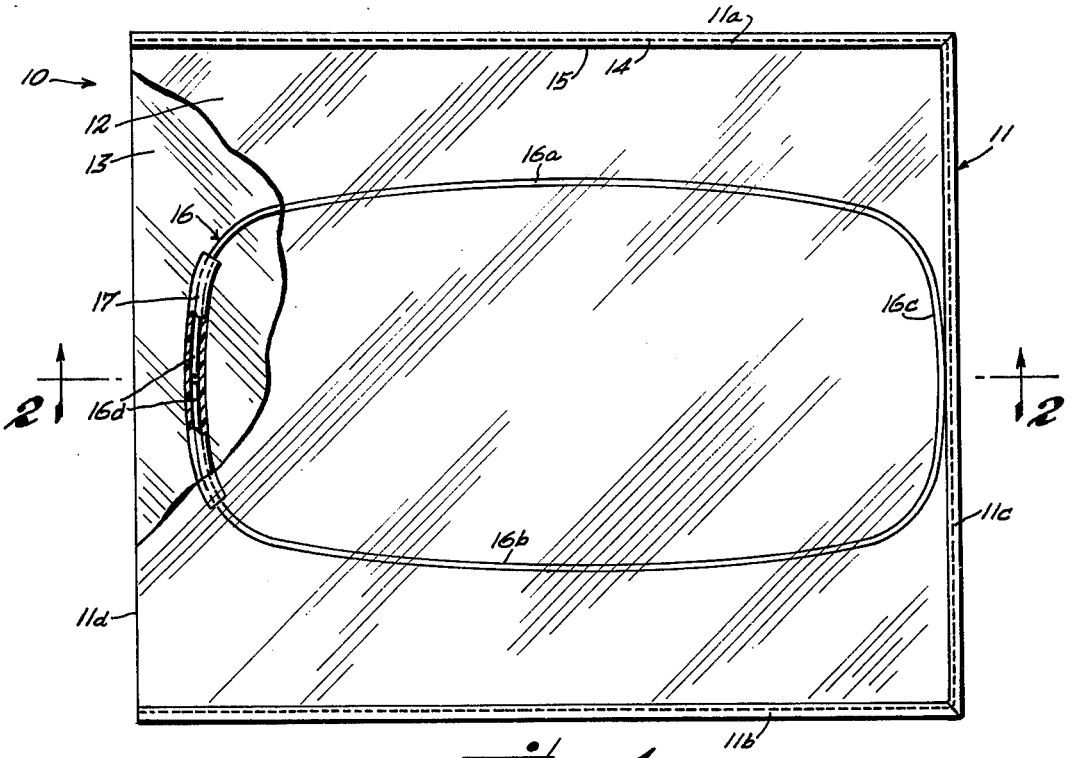
FIG. 1 is a top plan view of the portable and collapsible sitz bath receptacle embodying the invention shown in a flat, collapsed, storable condition, parts being broken away to show underlying structure.
Figure 2:
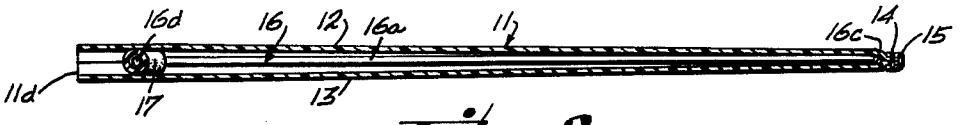
FIG. 2 is a sectional view taken on line 2—2 in FIG. 1.

Referring to detail to the drawing, 10 denotes a portable sitz bath receptacle constructed to embody the invention seen in FIGS. 1 and 2 to comprise an envelope 11 made of a suitable liquid impervious sheet material of appropriate thickness to wear well and withstand rough usage and yet be of sufficient flexibility to sag in the central portion thereof, 10 gauge polished vinyl sheeting having been found to render satisfactory results.

Envelope 11 is formed to two sheets, designated for purpose of description in FIGS. 1 and 2 as an upper sheet 12 and an under sheet 13. It will be clear that sitz bath receptacle 10 is reversible so that in use either sheet 12 or 13 of envelope 11 may be uppermost. Sheets 12 and 13 are secured together along three sides thereof, namely, along two opposite longitudinal edges 11*a* and 11*b* and along a rear transverse edge 11*c* by any suitable means, such as, heat sealing, or, as shown herein, stitching 14 which may be reinforced with tape 15 folded longitudinally over each edge. A double size sheet may be used which is folded over in half to provide the upper and under layers and the fold serving as one of the joined edges, in the well understood manner. The forth and front edge 11*d* of envelope 11 may remain open for access to the interior thereof.

Figure 3:
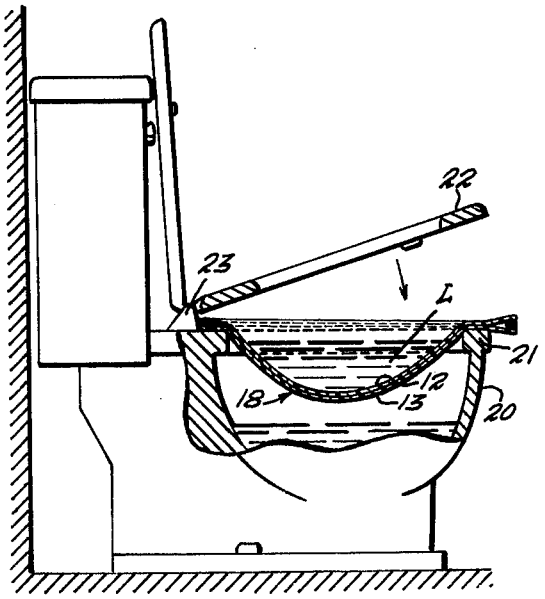
FIG. 3 is a side elevational view of a conventional toilet installation with parts in section showing the sitz bath receptacle in operative position on the bowl and filled with fluid to provide the sitz bath.
Figure 4:
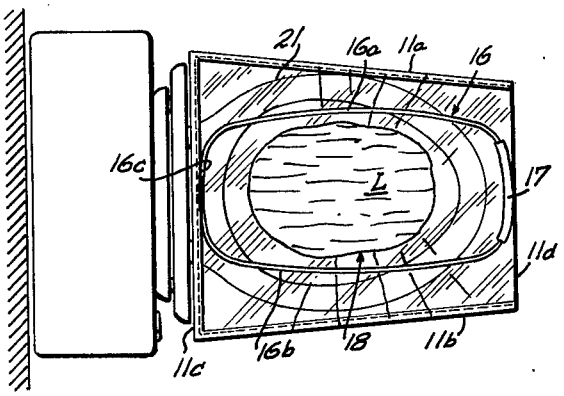
FIG. 4 is a top plan view of the installation shown in FIG. 3, but with the toilet seat fully raised for viewing the filled sitz bath.

A relatively rigid ring or frame 16 is located within envelope 11 and forms a support through which the central portion of upper sheet 12 sags cooperating with under sheet 13 to form sitz bowl 18 when receptacle 10 is positioned on the top rim 21 of a toilet bowl 20, as is clear from FIGS. 3 and 4. Frame 16 may be made of any suitable non-corrosive material having the requisite rigidity and strength, as for example, aluminium wire bent into an oblong shape having opposite longitudinal side portions 16*a* and 16*b* interconnected by a transverse rear portion 16*c* and having opposite free ends 16*d* which may meet at the middle of the front portion thereof. Ends 16*d* are retained in abutment relation by a sleeve 17 which is also preferably made of water impervious material, such as, a vinyl plastic, and serves as a hand gripping means for manipulating sitz bath receptacle 10.

As seen in FIG. 1, frame 16 is sized to be approximately one half the width of, and slightly shorter than, envelope 11 and is located centrally thereof between the seams of longitudinal edges 11*a* and 11*b*, and has rear portion 16*c* substantially against the seam of rear transverse edge 11*c* which locates sleeve 17 slightly inwardly of open front edge 11*d*.

In use, sitz bath receptacle 10, constructed as shown in FIGS. 1 and 2 and hereinbefore described, is placed on the top rim of any conventional toilet bowl 20 after first having raised the seat 22. Envelope 11 is centralized on bowl 20 with rear transverse edge 11*c* placed against toilet seat hinges 23 so that frame rear portion 16*c* rests on the rear portion of rim 21 and frame 16 extends forwardly, being centralized with respect to toilet bowl 20 and having a front section of each longitudinal side portion 16*a* and 16*b* extending across and resting on the front section of toilet rim 21, as is clear from FIG .4. The center of envelope 11 between frame longitudinal side portions 16*a* and 16*b* is then depressed with the palm of the hand causing opposite edges 11*a*, 11*b* and front open edge 11*d* to approach frame 16 and form sitz bowl 18 which is then filled with approximately 1½ quarts of liquid L providing the sitz bath. The toilet seat 22 is then lowered onto installed and filled receptacle 10 which is ready for use.

In addition to medicating by soaking the parts of the body which, when seated on seat 22, are bathed by liquid L having appropriate medication, soaking in hot water has been found by elderly persons suffering from constipation to bring relief and induce a bowel movement which will be discharged into bowl 18. After use, to dispose of the contents of bowl 18, toilet seat 22 is raised, receptacle 10 is grasped by sleeve 17 and pulled forwardly and upwardly until rear portion 16*c* of frame 16 becomes unseated from rim 21 and the rear edge 11*c* drops into the toilet bowl 20 depositing the contents therein. The toilet may then be flushed while holding on to receptacle 10 which is then slipped upwardly and forwardly out of the toilet bowl 20 for washing with soap and water in a nearby basin.

From FIGS. 1 and 4, it will be apparent that the open front edge 11*d* of envelope 11 permits frame 16 to be removed and bent into either a wider and shorter or a narrower and longer configuration to better fit the shape of the toilet bowl rim 21. In case of a narrower and longer frame 16, when in use, the front frame portion bearing sleeve 17 may extend beyond the open front edge 11*d* which accommodates the greater length.

It will also be apparent from viewing FIG. 1 that for packaging and storing purposes, sitz bath receptacle 10 may be collapsed to lie relatively flat and further reduced in size to occupy only an area substantially equivalent to frame 16. This is readily accomplished by folding over as flaps onto the center area of envelope 11 containing frame 16 the side sections of envelope 11 which extend beyond the longitudinal side portions 16*a* and 16*b* of frame 16.

The portable and collapsible sitz bath receptacle is seen to achieve the several objects of the invention and to be well adapted to meet conditions of practical use. As various possible embodiments might be made of this invention, and as various changes might be made in the disclosed structure, it is to be understood that all matters herein set forth or shown in the accompanying drawing are to be interpreted as illustrative and not in a limiting sense.

What is claimed is:

1. A portable and collapsible receptacle providing a sitz bath when installed on the rim of a toilet bowl beneath the seat, comprising an envelope of water impervious and pliable sheet material sized and shaped to rest on and overlap said toilet bowl rim, a relatively rigid frame within said envelope having a width narrower than the envelope and a length sufficient to rest on rear and front portions of the toilet bowl rim as a support for the envelope, said frame being free within said envelope for relative movement of the sheet material of the envelope with respect to the frame permitting the envelope when positioned on said toilet bowl rim to be depressed in a center portion thereof to provide a bowl for filling with liquid for said sitz bath.

2. The receptacle defined in claim 1, in which said envelope sheet material comprises two superimposed sheets of vinyl plastic sewn together along two opposite longitudinal edge seams and a transverse rear edge seam, and said envelope has an open front edge for access to the frame within the envelope.

3. The receptacle defined in claim 1, in which said frame is formed of a non-corrosive wire bent into an oblong shape with longitudinal side portions interconnected by a transverse rear portion and opposite free ends meeting at the middle of a front portion, and means for retaining said free ends in substantial abutment, said longitudinal side portions being said frame length for said resting on the toilet bowl rim.

4. The receptacle defined in claim 3, in which said retaining means is a sleeve substantially the length of said front portion and into which said wire free ends extend.

* * * * *